US007438747B2

(12) United States Patent
Luo

(10) Patent No.: US 7,438,747 B2
(45) Date of Patent: Oct. 21, 2008

(54) NEGATIVE ION GENERATOR

(76) Inventor: Chin-Kuang Luo, 5F, No. 56, Min-Chuan Rd., Chung Dist., Taichung City (TW)

( * ) Notice: Subject to any disclaimer, the term of this patent is extended or adjusted under 35 U.S.C. 154(b) by 340 days.

(21) Appl. No.: 11/324,631

(22) Filed: Jan. 4, 2006

(65) Prior Publication Data

US 2006/0214111 A1 Sep. 28, 2006

(30) Foreign Application Priority Data

Mar. 28, 2005 (TW) ..... 94109631 A

(51) Int. Cl.
*B03C 3/41* (2006.01)

(52) U.S. Cl. ..... 96/96; 96/97; 361/226; 361/233

(58) Field of Classification Search ..... 96/66, 96/69, 95–97, 99; 361/225–235
See application file for complete search history.

(56) References Cited

U.S. PATENT DOCUMENTS

| | | | | | |
|---|---|---|---|---|---|
| 2,589,463 | A * | 3/1952 | Warburton | ..... | 96/66 |
| 4,828,586 | A * | 5/1989 | Joannou | ..... | 96/66 |
| 5,108,470 | A * | 4/1992 | Pick | ..... | 96/58 |
| 5,573,577 | A * | 11/1996 | Joannou | ..... | 96/66 |
| 5,807,425 | A * | 9/1998 | Gibbs | ..... | 96/66 |
| 5,846,302 | A * | 12/1998 | Putro | ..... | 96/66 |
| 6,955,708 | B1 * | 10/2005 | Julos et al. | ..... | 95/59 |
| 7,112,238 | B2 * | 9/2006 | Joannou | ..... | 96/66 |
| 2005/0109204 | A1 * | 5/2005 | Coppom et al. | ..... | 95/15 |

* cited by examiner

*Primary Examiner*—Richard L Chiesa
(74) *Attorney, Agent, or Firm*—Lowe Hauptman Ham & Berner LLP

(57) ABSTRACT

A negative ion generator includes: a flat dielectric layer having a planar surface; a plurality of conductive lines that are attached to the planar surface of the dielectric layer, and that define a plurality of ion-discharging points, respectively; and a high voltage generating circuit coupled to the conductive lines for actuating emission of electrons from the ion-discharging points of the conductive lines.

10 Claims, 9 Drawing Sheets

NEGATIVE ION GENERATOR

CROSS-REFERENCE TO RELATED APPLICATION

This application claims priority of Taiwanese application no. 094109631, filed on Mar. 28, 2005.

BACKGROUND OF THE INVENTION

1. Field of the Invention

The invention relates to a negative ion generator, more particularly to a negative ion generator having a conductive screen formed with a plurality of ion-discharging points.

2. Description of the Related Art

Negative ions provide a good influence on the living body, such as a healthy effect of preventing oxidization of the human body, a deodorizing effect, an effect of maintaining the freshness of foodstuff, etc. Various types of negative ion generators, which generate negative ions by negatively charging gas molecules, such as oxygen molecules, and fine air particles, can be used in applications, such as air cleaners.

Referring to FIG. 1, a conventional negative ion generating device 1 is shown to be adapted to be connected to an AC power supply for generating negative ions, and includes a negative ion generator 11, and a stylus electric discharge electrode 12 connected to the negative ion generator 11. The negative ion generator 11 includes a drive circuit 111 connected electrically to the AC power supply, a high voltage transformer 112 connected to the drive circuit 11 for performing electromagnetic coupling amplification by electromagnetic induction, and a rectifying circuit 113 connected to the high voltage transformer 112 for rectifying the transformer output into a DC voltage and having an output end 110 connected to the stylus electric discharge electrode 12.

This type of negative ion generating device is disadvantageous in that since there is only a small number of discharging points for ion generation, the number of ions generated thereby is quite limited.

To overcome the aforesaid drawback, referring to FIG. 2, there is another conventional negative ion generating device 1 that includes a strand of carbon fibers 132 sleeved by a sleeve 131. Each of the carbon fibers 132 has an ion-discharging point. However, the ion-discharging points of the carbon fibers 132 are confined to a relatively small area, which has an adverse effect on uniform spreading of the negative ions in a space.

SUMMARY OF THE INVENTION

Therefore, the object of the present invention is to provide a negative ion generator that can overcome the aforesaid drawbacks of the conventional negative ion generators.

According to one aspect of the present invention, there is provided a negative ion generator that comprises: a flat dielectric layer having a planar surface; a plurality of conductive lines that are attached to the planar surface of the dielectric layer, and that define a plurality of ion-discharging points, respectively; and a high voltage generating circuit coupled to the conductive lines for actuating emission of electrons from the ion-discharging points of the conductive lines.

According to another aspect of the present invention, there is provided a negative ion generator that comprises a conductive screen and a high voltage generating circuit. The conductive screen includes a plurality of meshes, and is formed with a plurality of cutouts which result in formation of a plurality of ion-discharging points. Each of the cutouts has an area larger than that of each of the meshes, and is bounded by respective ones of the ion-discharging points. The high voltage generating circuit is coupled to the conductive screen for actuating emission of electrons from the ion-discharging points of the conductive screen.

According to yet another aspect of the present invention, there is provided a method for making a negative ion generator. The method comprises the steps of:

a) forming a conductive screen having a plurality of meshes;

b) forming the conductive screen with a plurality of cutouts which result in formation of a plurality of ion-discharging points, each of the cutouts having an area larger than that of each of the meshes and being bounded by respective ones of the ion-discharging points; and c) coupling the conductive screen to a high voltage generating circuit for generating negative ions.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
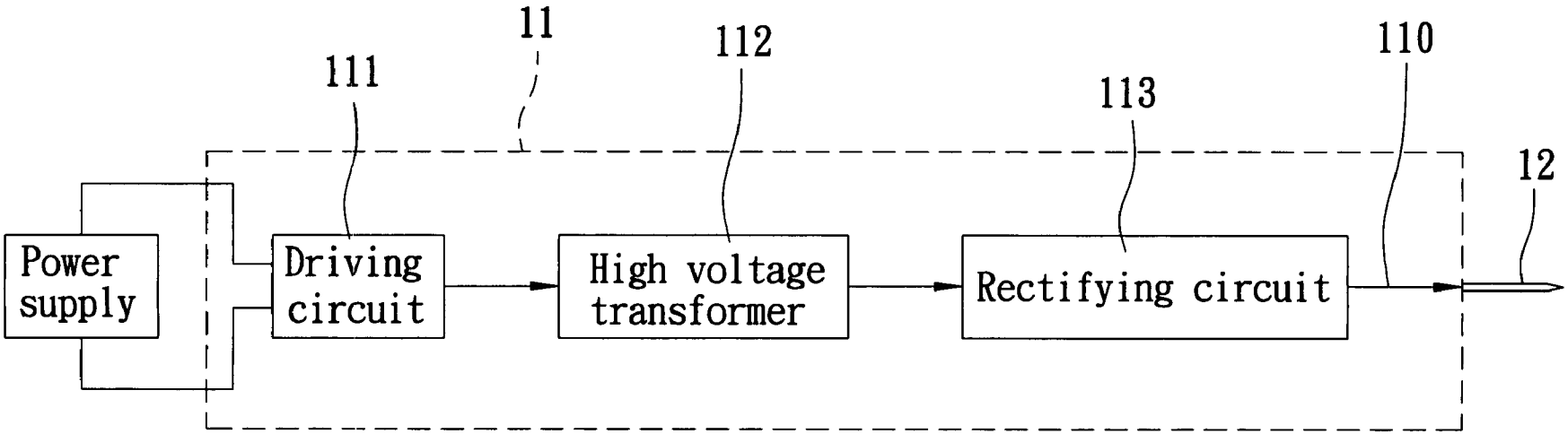
FIG. 1 PRIOR ART
FIG. 1 is a system block diagram of a conventional negative ion generator.
Figure 2:
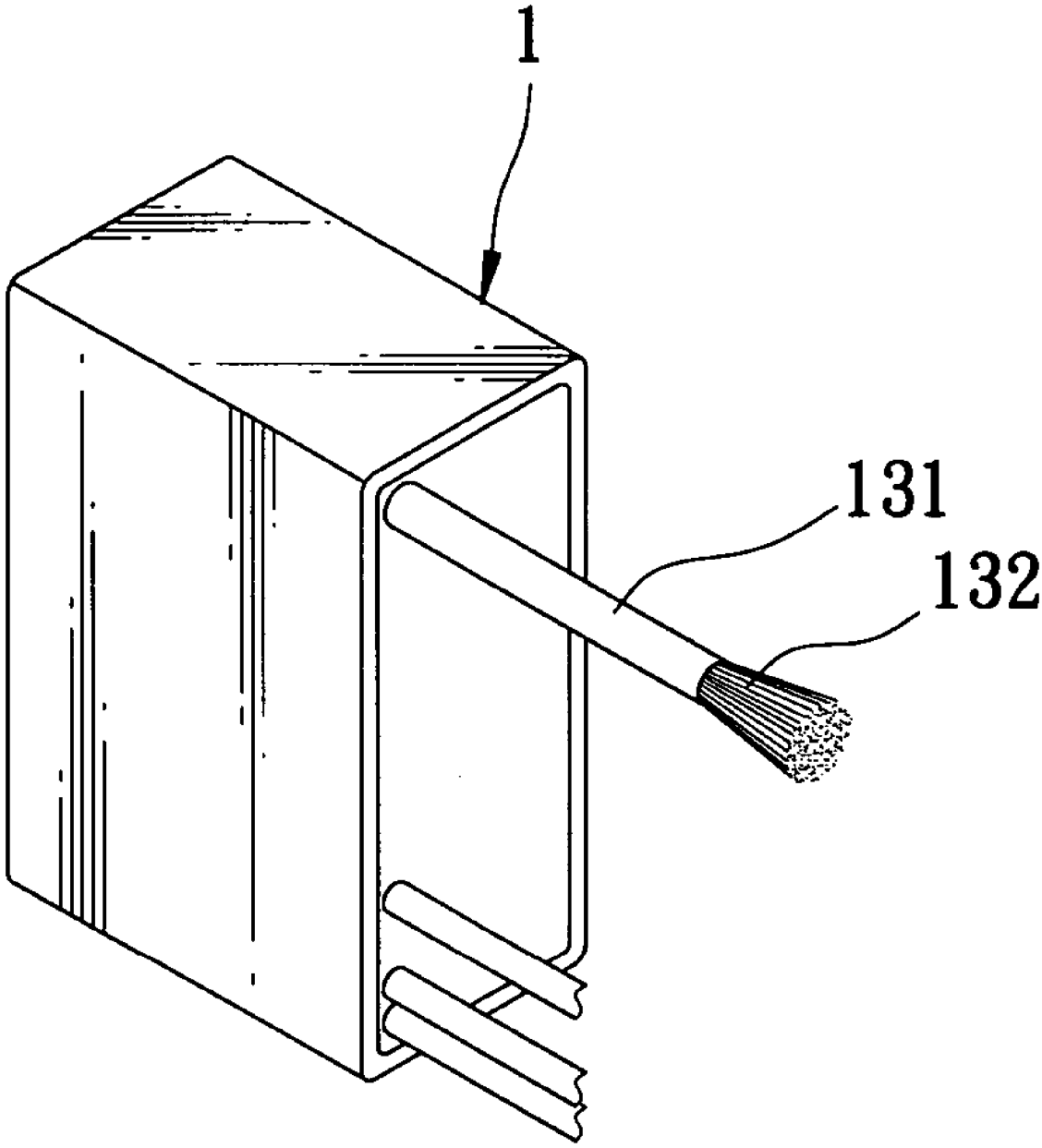
FIG. 2 PRIOR ART
FIG. 2 is a perspective view of another conventional negative ion generator.

Before the present invention is described in greater detail with reference to the accompanying preferred embodiments, it should be noted herein that like elements are denoted by the same reference numerals throughout the disclosure.

Figure 3:
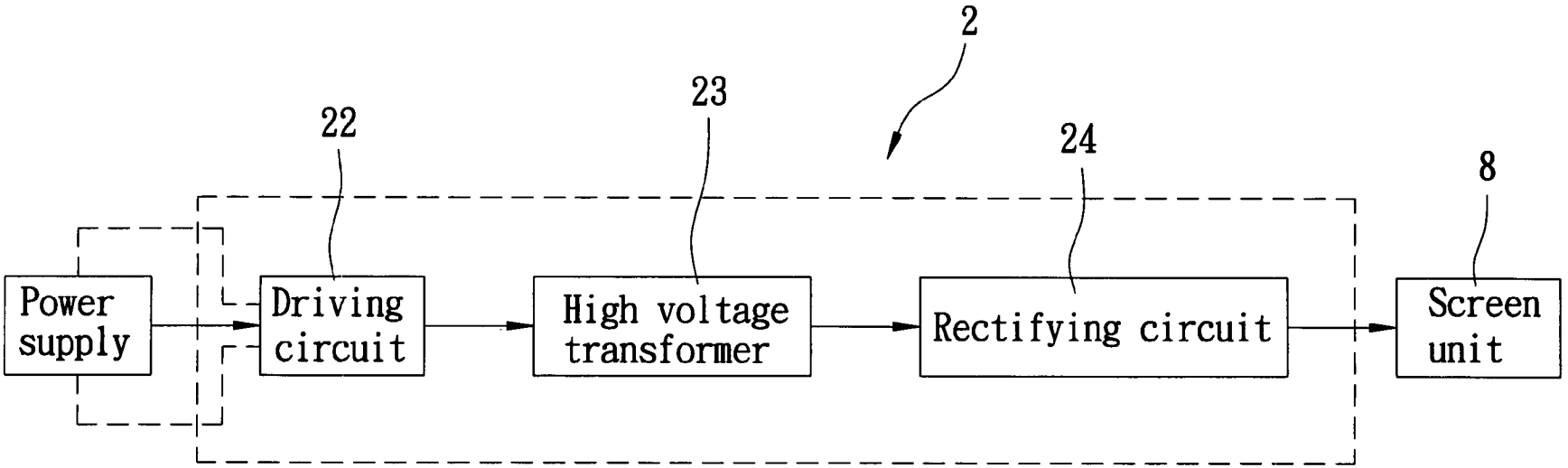
FIG. 3 is a system block diagram of the first preferred embodiment of a negative ion generator according to the present invention.
Figure 4:
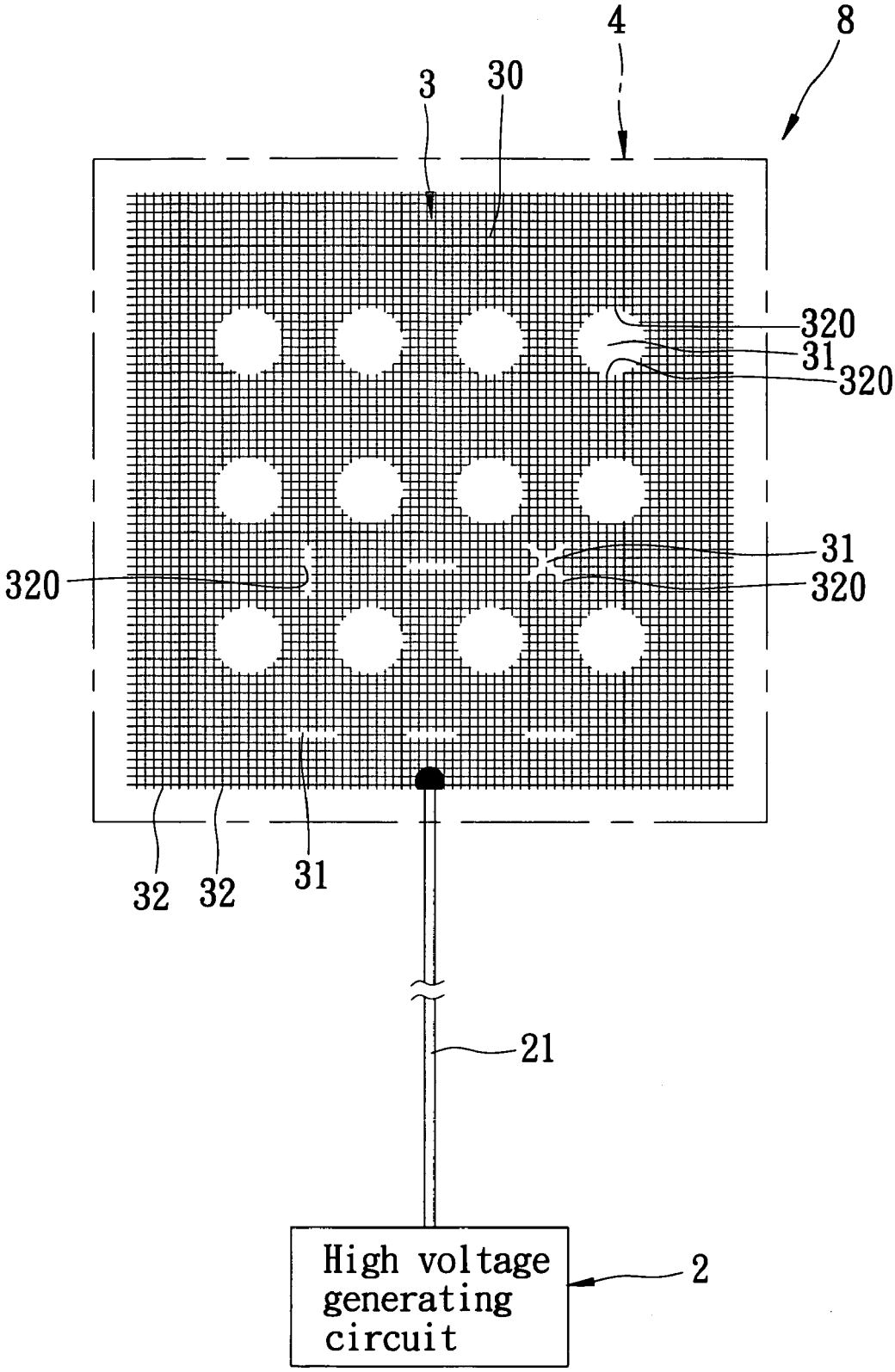
FIG. 4 is a schematic planar view of the first preferred embodiment of the negative ion generator.
Figure 5:
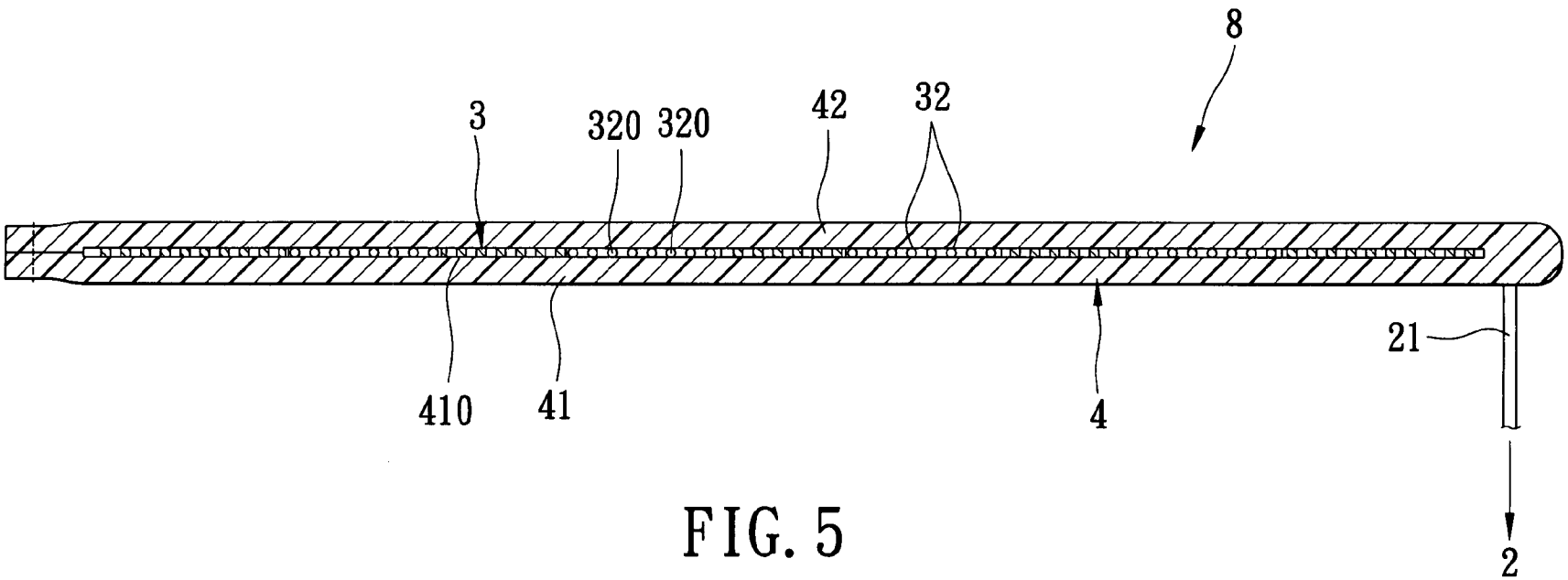
FIG. 5 is an assembled sectional view of the first preferred embodiment of the negative ion generator.

Referring to FIGS. 3 to 5, the first preferred embodiment of a negative ion generator according to the present invention is shown to be adapted to be connected to an AC power supply for generating negative ions.

The negative ion generator of this invention is formed by a method that includes the steps of: forming a conductive screen 3 with a plurality of meshes 30; forming the conductive screen 3 with a plurality of cutouts 31 by punching; coupling the conductive screen 3 to a high voltage generating circuit 2 through a conductive wire line 21; and enclosing the conductive screen 3 with an enclosure 4. The conductive screen 3 and the enclosure 4 cooperatively form an ion-generating unit 8.

The high voltage generating circuit 2 includes a drive circuit 22 connected electrically to the AC power supply, a high voltage transformer 23 connected to the drive circuit 22 for performing electromagnetic coupling amplification by electromagnetic induction, and a rectifying circuit 24 connected to the high voltage transformer 23 for rectifying the transformer output into a DC voltage.

The enclosure 4 has a flat dielectric layer 41 (see FIG. 5) which has a planer inner surface 410. The conductive screen 3 includes a plurality of conductive lines 32 that are interweaved to form the meshes 30 and that are adhesively attached to the inner surface 410 of the dielectric layer 41 so as to lie firmly on the same plane. Each of the cutouts 31 results in formation of a plurality of ion-discharging points 320. In this embodiment, the cutouts 31 have different shapes, i.e., circular, cross and rectangular in shape. In practice, the cutouts 31 may as well take other geometric shapes such as triangles, stars, pentagons, etc., as long as the purpose of increasing the number of ion-discharging points 320 is served. Also, in this embodiment, the conductive lines 32 are made from carbon fibers or copper filaments. The enclosure 4 further has a cover 42 that is connected to a periphery of the dielectric layer 41 so as to cooperate with the dielectric layer 41 to enclose the conductive lines 32. In this embodiment, the enclosure 4 is made from a waterproof and air-permeable material for protection of the conductive screen 3.

In use, the high voltage generating circuit 2 is connected to the power supply and the conductive lines 32 so as to provide electricity for actuating emission of electrons from the ion-discharging points 320 of the conductive lines 32. In the case of application to an air cleaner, a larger number of negative ions are generated to charge gas molecules, such as oxygen molecules, and fine air particles so as to clean ambient air.

Figure 6:
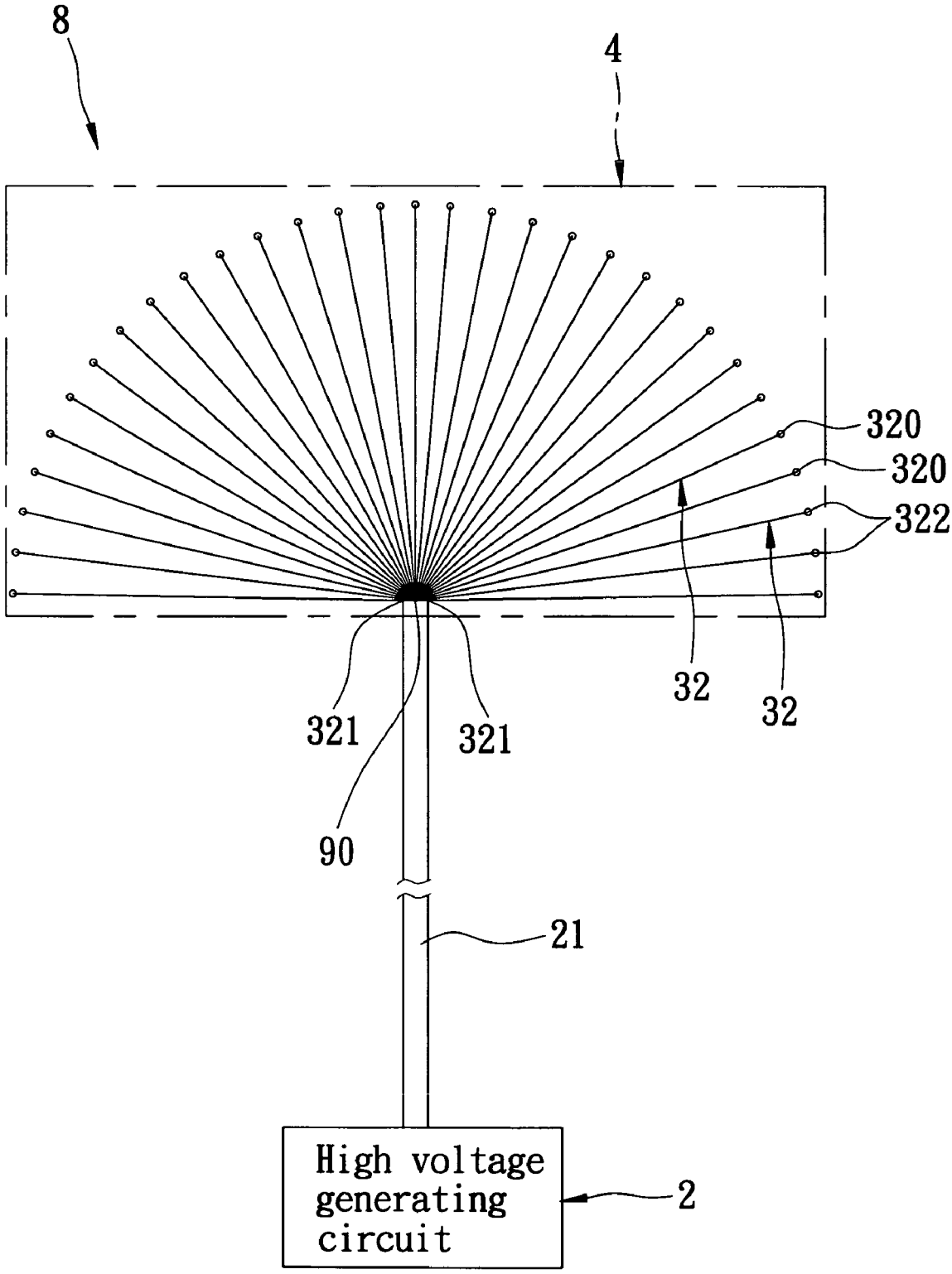
FIG. 6 is a schematic planar view of the second preferred embodiment of a negative ion generator according to the present invention, wherein conductive lines thereof are arranged in semi-circular formation.

Referring to FIG. 6, the second preferred embodiment of a negative ion generator of this invention is shown to differ from the first preferred embodiment in that the conductive lines 32 include connecting ends 321 grouped together at a converging point 90 connected to the high voltage generating circuit 2 through the wire line 21, and discharging ends 322 opposite to the connecting ends 321 and defining the ion-discharging points 320, respectively. The conductive lines 32 are arranged in a semi-circular formation and converge at the converging point 90.

Figure 7:
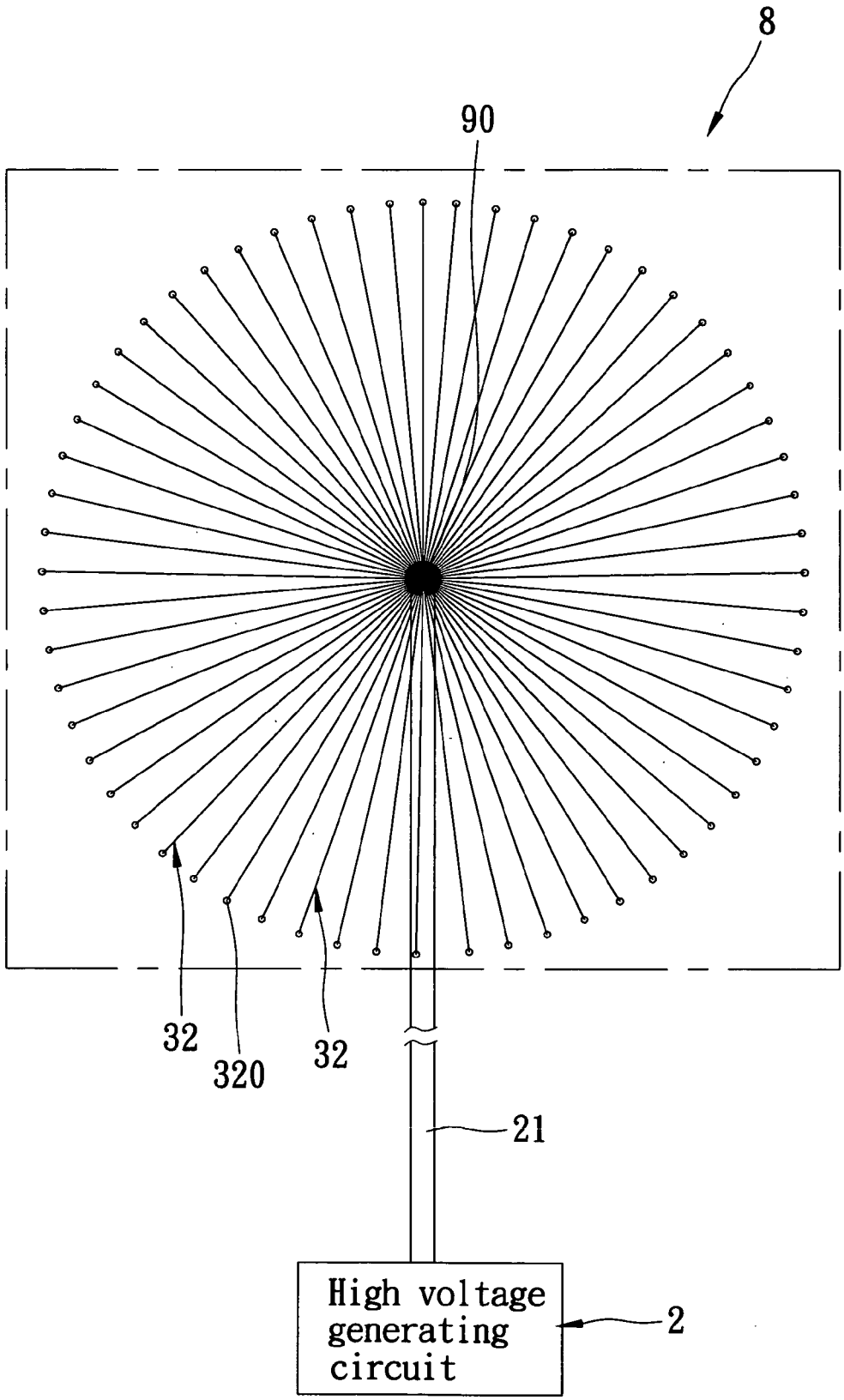
FIG. 7 is a schematic planar view of the third preferred embodiment of a negative ion generator according to the present invention, wherein conductive lines thereof are arranged in circular formation.

Referring to FIG. 7, the third preferred embodiment of a negative ion generator according to the present invention is shown to differ from the second preferred embodiment in that the conductive lines 32 are arranged in a circular formation and converge at a center of the circular formation which defines the converging point 90.

In the second and third preferred embodiments, each of the conductive lines 5 may include a strand of carbon fibers in order to form more ion-discharging points 320.

Figure 8:
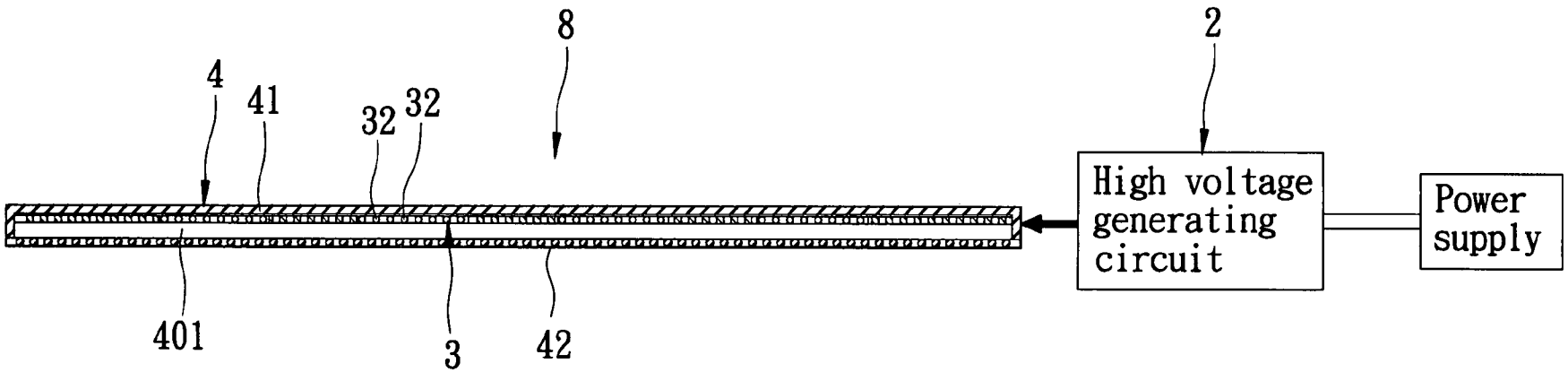
FIG. 8 is an assembled sectional view of the fourth preferred embodiment of a negative ion generator according to the present invention.

Referring to FIG. 8, the fourth preferred embodiment of a negative ion generator according to the present invention is shown to differ from the first preferred embodiment in that the cover 42 is separated from the conductive screen 3 by a clearance 401 and is made from metal. The fourth preferred embodiment is suitable for applications, such as a kitchen hood.

Figure 9:
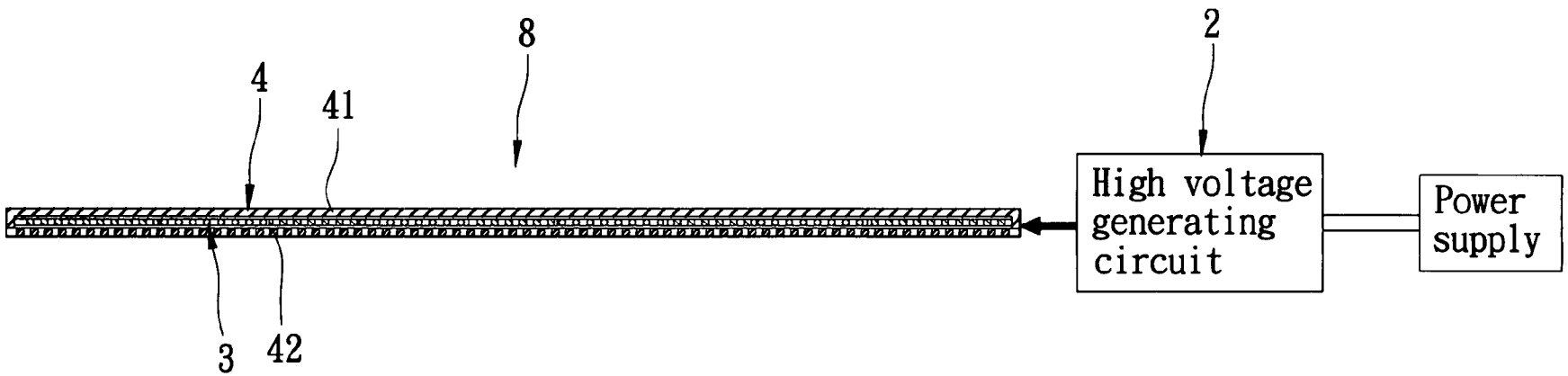
FIG. 9 is an assembled sectional view of the fifth preferred embodiment of a negative ion generator according to the present invention.

Referring to FIG. 9, the fifth preferred embodiment of a negative ion generator according to the present invention is shown to differ from the first embodiment in that the cover 42 and the dielectric layer 41 are integrally formed from a plastic material.

The negative ion generator of this invention is made planar, i.e., the conductive lines 32 are laid on a plane, thereby permitting the same to be suitable for applications that require a large area for uniform spreading of the negative ions discharged from the ion-discharging points 320 of the conductive lines 32. Moreover, with the inclusion of the conductive screen 3 in the negative ion generator of this invention, a large number of the ion-discharging points 320 can be formed easily.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A negative ion generator comprising:

a flat dielectric layer having a planar surface;

a screen including a plurality of conductive lines that are attached to said planar surface of said dielectric layer, and that define a plurality of ion-discharging points, respectively; and a high voltage generating circuit coupled to said conductive lines for actuating emission of electrons from said ion-discharging points of said conductive lines;

said screen having a plurality of meshes, and a plurality of spaced apart cutouts forming said ion-discharging points, each of said cutouts having an area larger than that of each of said meshes and being bounded by respective ones of said ion-discharging points.

2. The negative ion generator as claimed in claim 1, wherein each of said cutouts is circular in shape.

3. The negative ion generator as claimed in claim 1, wherein each of said cutouts is cross-shaped.

4. The negative ion generator as claimed in claim 1, wherein each of said cutouts is rectangular in shape.

5. The negative ion generator as claimed in claim 1, further comprising a cover that is connected to a periphery of said dielectric layer so as to cooperate with said dielectric layer to form an enclosure to enclose said conductive lines.

6. A negative ion generator comprising:

a conductive screen having a plurality of meshes and formed with a plurality of cutouts which result in formation of a plurality of ion-discharging points, each of said cutouts having an area larger than that of each of said meshes and being bounded by respective ones of said ion-discharging points; and a high voltage generating circuit coupled to said conductive screen for actuating emission of electrons from said ion-discharging points of said conductive screen.

7. The negative ion generator as claimed in claim 6, wherein each of said cutouts is circular in shape.

8. The negative ion generator as claimed in claim 6, wherein each of said cutouts is cross-shaped.

9. The negative ion generator as claimed in claim 6, wherein each of said cutouts is rectangular in shape.

10. The negative ion generator as claimed in claim 6, further comprising an enclosure to enclose said conductive screen therein.

* * * * *